US010548411B2

(12) United States Patent
Oh

(10) Patent No.: US 10,548,411 B2
(45) Date of Patent: Feb. 4, 2020

(54) FOAM MATTRESS WITH SYMMETRICAL WAVY FOAM LAYERS

(71) Applicant: Zinus Inc., Tracy, CA (US)

(72) Inventor: Suk Kan Oh, Xiamen (CN)

(73) Assignee: Zinus Inc., Tracy, CA (US)

( * ) Notice: Subject to any disclaimer, the term of this patent is extended or adjusted under 35 U.S.C. 154(b) by 0 days.

(21) Appl. No.: 16/436,375

(22) Filed: Jun. 10, 2019

(65) Prior Publication Data

US 2019/0290014 A1 Sep. 26, 2019

Related U.S. Application Data

(63) Continuation of application No. 13/780,100, filed on Feb. 28, 2013, now Pat. No. 10,357,115.

(51) Int. Cl.
*A47C 27/14* (2006.01)
*A47C 27/15* (2006.01)

(52) U.S. Cl.
CPC ..... *A47C 27/146* (2013.01); *A47C 27/144* (2013.01); *A47C 27/148* (2013.01); *A47C 27/15* (2013.01)

(58) Field of Classification Search
CPC ... A47C 27/146; A47C 27/148; A47C 27/144; A47C 27/15
See application file for complete search history.

(56) References Cited

U.S. PATENT DOCUMENTS 951,682 A 3/1910 Etter ..... 5/701
2,469,084 A 5/1949 Schenker ..... 5/728
3,026,544 A 3/1962 Persicke et al. ..... 428/101
3,222,697 A * 12/1965 Scheermesser ..... A47C 27/144 428/160
3,319,274 A 5/1967 Upton ..... 5/701
3,885,258 A 5/1975 Regan ..... 5/727
4,229,847 A 10/1980 Degen ..... 5/724
4,628,557 A 12/1986 Murphy ..... 5/723
(Continued)

FOREIGN PATENT DOCUMENTS

GB 804094 8/1955

OTHER PUBLICATIONS

Marketing material for Harmony mattress from Wellnesss Schlafen Gesundheit GmbH, Voecklamarkt, Austria, downloaded from www.wellnesstower.com on Feb. 28, 2013 (3 pages).

*Primary Examiner* — Eric J Kurilla
(74) *Attorney, Agent, or Firm* — Imperium Patent Works; Darien K. Wallace

(57) ABSTRACT

A symmetrical zoned foam mattress includes an upper foam layer with a wavy lower side and a lower foam layer with a wavy upper side. The lower layer has top, middle and bottom lateral valleys. The wavy lower side of the upper layer is glued to the wavy upper side of the lower layer. The top lateral valley has a minimum located within eighteen inches of the top head end of the lower layer. The bottom lateral valley has a minimum located within eighteen inches of the bottom foot end of the lower layer. A center plane intersects the lower foam layer at a minimum of the middle lateral valley. The minimum of each of the top and bottom lateral valleys is about fifteen inches from the end of the mattress regardless of whether the consumer chooses to use the top or bottom end as the head of the mattress.

18 Claims, 7 Drawing Sheets

(56) References Cited

U.S. PATENT DOCUMENTS

| | | | | |
|---|---|---|---|---|
| 4,644,593 | A * | 2/1987 | O'Brien | A47C 27/148 297/284.3 |
| 4,665,573 | A | 5/1987 | Fiore | 5/731 |
| 4,673,452 | A | 6/1987 | Awdhan | 156/254 |
| 4,980,936 | A | 1/1991 | Frickland | 5/420 |
| 5,048,136 | A | 9/1991 | Popitz | 5/603 |
| 6,807,698 | B2 | 10/2004 | Torbet et al. | 5/727 |
| 2003/0221262 | A1 | 12/2003 | Torbet | 5/713 |
| 2005/0115003 | A1 | 6/2005 | Torbet et al. | 5/727 |
| 2005/0193497 | A1 | 9/2005 | Baker | 5/721 |
| 2006/0260060 | A1 | 11/2006 | Apperson et al. | 5/691 |
| 2008/0060139 | A1 | 3/2008 | Mossbeck | 5/724 |
| 2010/0264571 | A1 | 10/2010 | Tarazona | 267/141 |
| 2011/0056025 | A1 | 3/2011 | Jew et al. | 5/724 |
| 2011/0283461 | A1 | 11/2011 | Rasmussen | 5/731 |
| 2012/0124753 | A1 | 5/2012 | Lee | 5/727 |
| 2014/0013505 | A1 | 1/2014 | Sportis et al. | 5/400 |

* cited by examiner

FOAM MATTRESS WITH SYMMETRICAL WAVY FOAM LAYERS

CROSS REFERENCE TO RELATED APPLICATION

This application is a continuation of, and claims priority under 35 U.S.C. § 120 from, nonprovisional U.S. patent application Ser. No. 13/780,100 entitled "Foam Mattress With Symmetrical Wavy Foam Layers," filed on Feb. 28, 2013, the subject matter of which is incorporated herein by reference.

TECHNICAL FIELD

The present invention relates to mattresses, and in particular to a zoned foam mattress.

BACKGROUND INFORMATION

A comfortable mattress is crucial to providing high quality sleep. One way of making a mattress more comfortable is to provide multiple lateral zones of differing firmness that correspond to different areas of the body of the user of the mattress. Different portions of the user's body exert different pressures on the mattress. Thus, the lateral zones under the user's shoulders and hips are made of softer foam than the lateral zones under the user's torso and legs in order to allow the user's shoulders and hips to sink into the mattress and to allow the user's spine to remain straight.

A typical zoned foam mattress is made by gluing together lateral rectangular blocks of foam in which adjacent blocks have differing hardnesses. The indentation load deflection (ILD) is one measure of hardness defined in the ISO 2439 standard. The standard defines ILD as the force that is required to compress the foam to a specified percentage of its original thickness using a circular plate of fifty square inches. For example, the 25%-compression ILD is the most commonly used ILD and is the number of pounds required to achieve the 25% compression. ILD is also measured at 40% and 60% compression.

FIG. 1 (prior art) is a cut-away perspective view of a conventional zoned foam mattress 10. Mattress 10 includes an upper foam layer 11, a zoned foam layer 12, and a bottom foam layer 13. Upper foam layer 11 is made of visco-elastic polyurethane foam, otherwise known as memory foam. A person using mattress 10 lies directly on upper layer 11 through a thin quilted fiber padding 14 sewn to the mattress cover 15. Bottom foam layer 13 provides support for the other layers and is made of "high density" (HD) polyurethane foam. The term of art "high density" foam is somewhat of a misnomer because upper layer 11 of memory foam has a higher density than does the HD polyurethane foam. Typically, the HD foam used in mattresses has a density of between 1.5 to 2.5 pounds per cubic foot, whereas memory foam typically has a density between three and 5.5 pounds per cubic foot. Zoned foam layer 12 rests on bottom foam layer 13.

Zoned foam mattress 10 is a Queen size mattress that is sixty inches wide and eighty inches from the top end 16 to the bottom end 17 of mattress 10. Zoned foam layer 12 includes longitudinally spaced, transversely extending lateral regions 18-21 of foam. A first lateral region 18 is located at top end 16 of mattress 10. A second lateral region 19 is disposed between first lateral region 18 and a third lateral region 20. The user of mattress 10 sleeps with his or her shoulders over second lateral region 19 and his or her hips above a fourth lateral region 21. Regions 19 and 21 have a lower ILD than do regions 18 and 20. Consequently, the user's shoulders and hips sink deeper into regions 19 and 21.

However, forming a mattress by gluing together lateral blocks of foam having different degrees of hardness complicates the manufacturing process and adds to the cost of the mattress. In addition, the many glued joints create more places for the mattress to come apart. A method is sought for making a zoned foam mattress that does not require gluing together lateral rectangular blocks of foam to form the zones of different hardness.

SUMMARY

A symmetrical zoned foam mattress includes an upper foam layer with a wavy lower side and a lower foam layer with a wavy upper side. The foam of the upper layer is softer than the foam of the lower layer. For example, the upper layer is made of softer memory foam, and the lower layer is made of harder high density foam (HD foam). The lower foam layer has a top, middle and bottom lateral valleys. The wavy lower side of the upper foam layer is glued to the wavy upper side of the lower foam layer. The upper foam layer together with the lower foam layer have a combined thickness that remains constant from the top head side to the bottom foot side of the mattress. The top lateral valley has a minimum located within eighteen inches of the top head end of the lower foam layer. The bottom lateral valley has a minimum located within eighteen inches of the bottom foot end of the lower foam layer. A center plane intersects the lower foam layer at a minimum of the middle lateral valley. The minimum of each of the top and bottom lateral valleys is about fifteen inches from the end of the mattress regardless of whether the consumer chooses to use the top or bottom end as the head of the mattress.

A cross section of the wavy upper side of the lower foam layer forms a curve that is a mirror image of itself on either side of a center plane through the lower foam layer. Thus, the top lateral valley and the bottom lateral valley are disposed symmetrically to the center plane. Between the top lateral valley and the middle lateral valley, the lower foam layer has a top lateral hill with a maximum located within eighteen inches of the center plane. The zoned foam mattress has a lower indentation load deflection (ILD) above the top lateral valley than above other regions immediately adjacent to the top lateral valley. Thus, the memory foam of the top layer above the top lateral valley of the lower layer imparts an ILD to the mattress above the top lateral valley that allows a person's shoulders to sink into the mattress so as to keep the person's spine straight.

A method of making a symmetrical zoned mattress with wavy upper and lower foam layers includes cutting first and second slabs along a predetermined curve. The first slab is made of harder foam than the second slab. For example, the first slab is made of HD foam, and the second slab is made of memory foam. The first slab of foam is cut to form a first top lateral valley, a first top lateral hill and a middle lateral valley in an upper side of a first foam layer. Cutting the first slab forms a top piece and a bottom piece. The bottom piece includes the first top lateral valley and the first top lateral hill. The top piece has a first bottom lateral valley.

The first foam layer is formed by attaching the bottom piece to the top piece at the minimum of the middle lateral valley. The first top lateral valley and the first bottom lateral valley are disposed symmetrically to a center plane of the first foam layer that intersects the upper side of the first foam layer at the minimum of the middle lateral valley. The minimum of the first top lateral valley is located within eighteen inches of the top head side of the first foam layer. In addition, the second slab of foam is cut to form a second top lateral hill, a second top lateral valley and a middle lateral hill in a lower side of a second foam layer.

The lower side of the second foam layer is then placed over the upper side of the first foam layer such that the second top lateral hill fits into the first top lateral valley, and the middle lateral hill fits into the middle lateral valley. The first foam layer together with the second foam layer have a combined thickness that is constant. The first top lateral valley has a minimum located within eighteen inches from a maximum of the first top lateral hill. An indentation load deflection (ILD) above the top lateral valley is lower than above other lateral regions immediately adjacent to the top lateral valley after the lower side of the second foam layer is placed over the upper side of the first foam layer.

Further details and embodiments are described in the detailed description below. This summary does not purport to define the invention. The invention is defined by the claims.

BRIEF DESCRIPTION OF THE DRAWINGS

The accompanying drawings illustrate embodiments of the invention.

DETAILED DESCRIPTION

Figure 1:
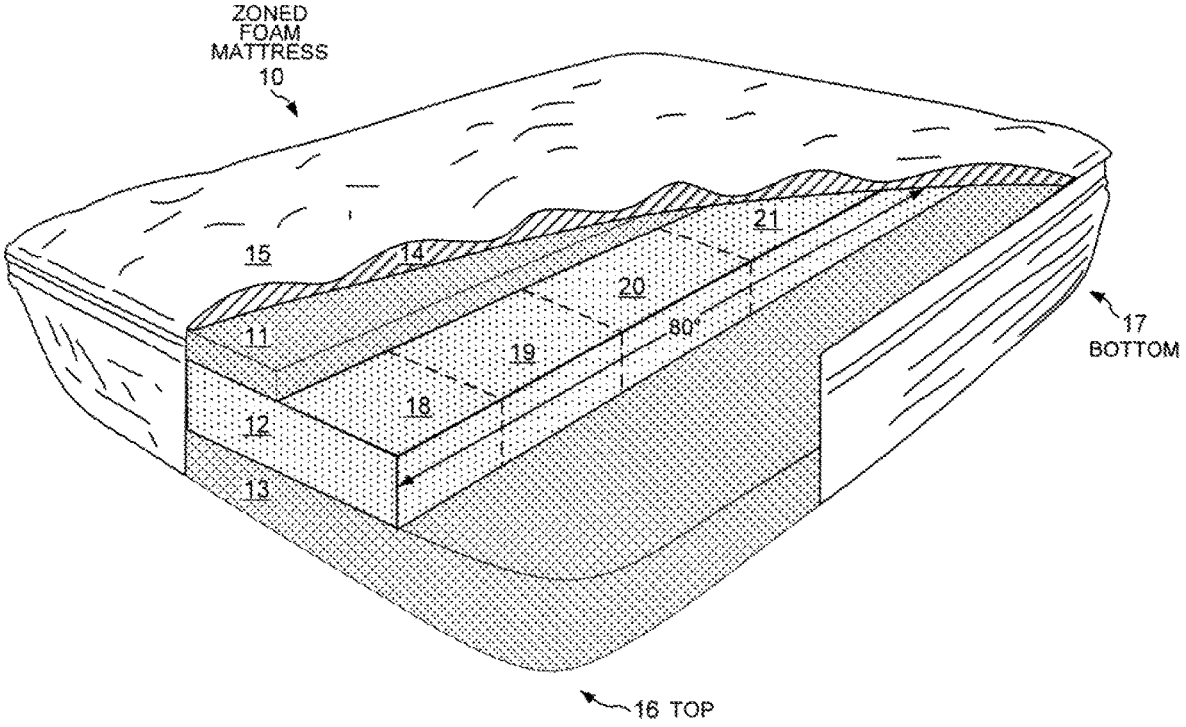
FIG. 1 (PRIOR ART)
FIG. 1 (prior art) is a perspective view of a zoned foam mattress with lateral rectangular blocks of foam exhibiting differing hardnesses.
Figure 2:
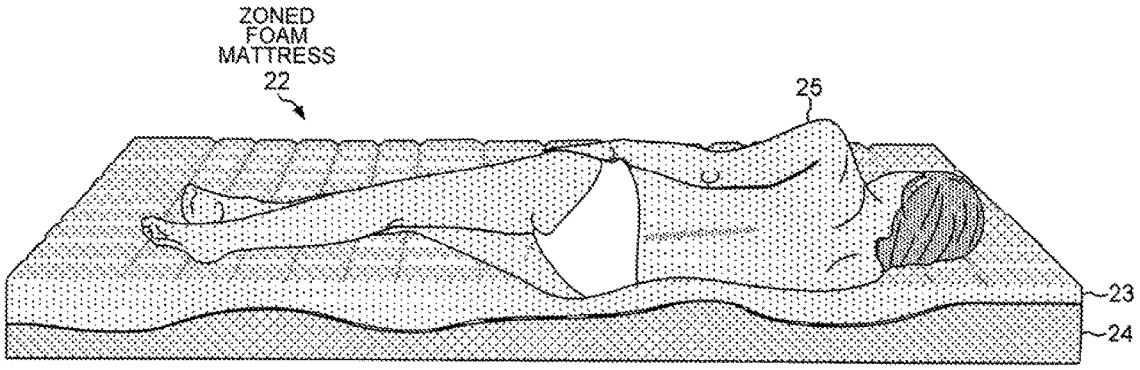
FIG. 2 is a perspective view of a zoned foam mattress showing the cross sectional curve of the wavy upper surface of a lower layer.

FIG. 2 is a perspective view of a zoned foam mattress 22 that does not include lateral, rectangular blocks of foam. Instead, the zones of varying hardness are formed by adjusting the relative thicknesses of an upper layer 23 of softer foam compared to a lower layer 24 of harder foam. The cross sectional curve of the upper surface of lower layer 24 corresponds to the contour of the body of a user 25 lying on mattress 22. The softer upper layer 23 is thicker under the user's shoulders and hips than under the user's torso and head. The curve between the wavy lower side of upper layer 23 and the wavy upper side of lower layer 24 is custom fit to the body of user 25.

One method of making zoned foam mattress 22 involves forming lower layer 24 in a mold whose lid produces the shape of the wavy upper side of lower layer 24. The lid is then removed from the cured lower layer 24, and a softer foam is poured over lower layer 24 to form upper layer 23 with a planar upper surface. But molding individual foam layers of mattress 22 is time consuming and therefore costly. A mattress with wavy foam layers is sought that can be manufactured in a more efficient manner.

Figure 3:
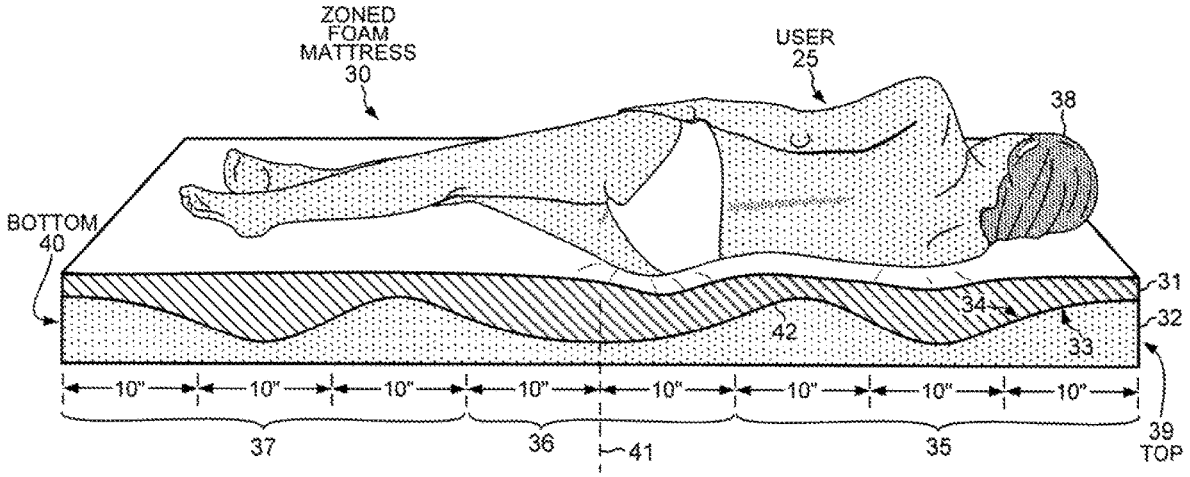
FIG. 3 shows a zoned foam mattress with a symmetrical curve between the wavy lower side of an upper foam layer and the wavy upper side of a lower foam layer.

FIG. 3 shows a pressure-relief, zoned foam mattress 30 of a first embodiment of the present invention that includes an upper foam layer 31 with a wavy lower side 33 and a lower foam layer 32 with a wavy upper side 34. Zoned foam mattress 30 can be manufactured without molding the wavy sides of layers 31-32 and without gluing together lateral foam blocks to form zones of different hardness. The zones of differing hardness of mattress 30 correspond to the thicker and thinner areas of the softer foam of upper foam layer 31. Upper foam layer 31 is made of visco-elastic polyurethane foam (memory foam), whereas lower foam layer 32 is made of high-density polyurethane foam (HD foam). Although HD foam typically has a lower density than memory foam, the HD foam used in mattress 30 is harder than the memory foam used in mattress 30. Harder foam has a higher indentation load deflection (ILD).

In another embodiment, lower foam layer 32 is formed from natural latex rubber (as opposed to HD foam) that also is harder than the memory foam used in the mattress. Wavy lower side 33 of upper foam layer 31 is adjacent to wavy upper side 34 of lower foam layer 32. Mattress 30 has a top portion 35, a middle portion 36 and a bottom portion 37. In FIG. 3, mattress 30 is an 80-inch long queen size mattress in which top portion 35 is thirty inches long, middle portion 36 is twenty inches long, and bottom portion 37 is thirty inches long. In other embodiments, mattress 30 is an 80-inch long king size mattress or a 75-inch long twin size mattress. FIG. 3 shows the head 38 of user 25 resting towards the top 39 of mattress 30, and the feet of user 25 are near the bottom 40 of mattress 30. However, the varying thicknesses of the foam layers 31-32 are symmetrical with respect to a center plane 41, and the head 38 of user 25 could just as comfortably be positioned toward the bottom 40 of mattress 30. It is also less expensive to produce mattress 30 because the cross-sectional curve 42 between foam layers 31-32 is symmetrical with respect to center plane 41.

Figure 4:
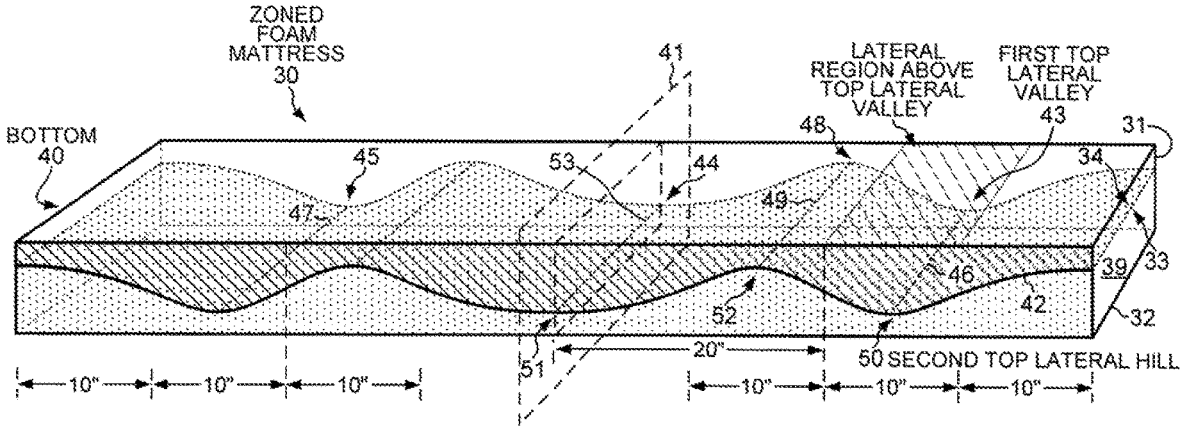
FIG. 4 is a perspective diagram of the zoned foam mattress of FIG. 3 showing the valleys and hills between the upper foam layer and the lower foam layer.

FIG. 4 is another perspective view of zoned foam mattress 30 showing the valleys and hills between upper foam layer 31 and lower foam layer 32 without user 25 lying on the mattress. Lower foam layer 32 has a first top lateral valley 43, a middle lateral valley 44 and a bottom lateral valley 45. First top lateral valley 43 has a minimum 46 located within eighteen inches of the top 39 of lower foam layer 32, and bottom lateral valley 45 has a minimum 47 located within eighteen inches of the bottom 40 of lower foam layer 32. Lower foam layer 32 also has a first top lateral hill 48 between first top lateral valley 43 and middle lateral valley 44. First top lateral hill 48 has a maximum 49 located within eighteen inches of center plane 41. Lower side 33 of upper foam layer 31 is positioned over upper side 34 of upper foam layer 31 such that a second top lateral hill 50 of upper foam layer 31 fits into first top lateral valley 43 of lower foam layer 32, and a middle lateral hill 51 of upper foam layer 31 fits into middle lateral valley 44 of lower foam layer 32.

Second top lateral valley 52 of upper foam layer 31 fits over first top lateral hill 48 of lower foam layer 32. The minimum 46 of first top lateral valley 43 is located within eighteen inches of maximum 49 of first top lateral hill 48.

Center plane 41 intersects lower foam layer 32 at a minimum 53 of middle lateral valley 44. The cross section of wavy upper side 34 follows curve 42, as does the cross section of wavy lower side 33. Upper foam layer 31 together with lower foam layer 32 have a combined thickness that remains constant from the top 39 to the bottom 40 of mattress 39. The portion of curve 42 extending from center plane 41 towards the top 39 of mattress 30 is a mirror image of the portion of curve 42 extending from center plane 41 towards the bottom 40 of mattress 30. Thus, top lateral valley 43 and bottom lateral valley 45 are disposed symmetrically relative to center plane 41. The memory foam above first top lateral valley 43 of lower foam layer 32 imparts an indentation load deflection (ILD) to the lateral region above top lateral valley 43 that allows the shoulders of user 25 to sink into mattress 30 so as to keep the user's spine straight. Thus, mattress 30 has a lower ILD above top lateral valley 43 than above other regions immediately adjacent to top lateral valley 43. Similarly, the hips of user 25 resting on the greater thickness of softer foam at middle lateral valley 44 sink into mattress 30 more than does the user's torso. The user's spine can remain straighter if both the user's hips and shoulders sink farther into the mattress than do the user's torso and legs.

Figure 5:
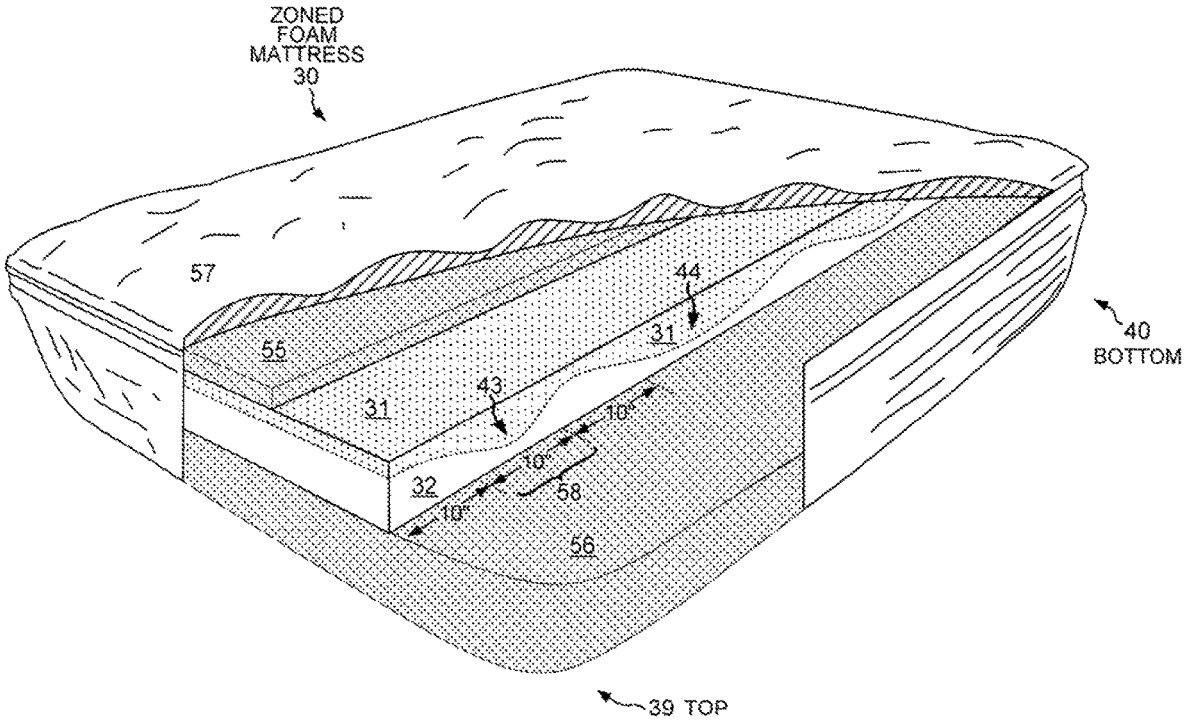
FIG. 5 is a cut-away perspective view of another embodiment of a zoned foam mattress with a symmetrical curve between upper and lower foam layers.

FIG. 5 is a cut-away perspective view of another embodiment of symmetrical zoned foam mattress 30. Mattress 30 includes a top foam layer 55, upper foam layer 31, lower foam layer 32, and a bottom foam layer 56. Bottom layer 56 provides support for the other layers and is made of a harder HD foam than is lower foam layer 32. Both top foam layer 55 and upper foam layer 31 are made of memory foam (visco-elastic polyurethane foam) that contains green tea and is colored green. User 25 lies directly on layer 55 through a thin quilted fiber padding 57 of the mattress cover. The green tea in top layer 55 acts as an antiodorant such that less of the chemical smell of the memory foam is perceived by user 25. In addition, people tend to perspire more while sleeping on memory foam. The bacteria and mold that would otherwise develop in the moist environment of the memory foam are killed by the green tea additive to the foam.

Mattress 30 is configured to provide optimum support for the largest percentage of North American consumers. The region 58 of the first top lateral valley 43 is about ten inches wide. In addition, region 58 of valley 43 is about ten inches from the top 39 of mattress 30. There are also about ten inches between region 58 of valley 43 and the region of middle lateral valley 44. The average consumer, regardless of body height, sleeps with his or her head the same distance from the top of the mattress. Thus, the average North American consumer sleeps with his or her shoulders about fifteen inches from the top of the mattress. The middles of lateral valleys 43 and 45 are both about fifteen inches from the "head" of mattress 20 regardless of whether user 25 chooses to use the top 39 or the bottom 40 as the head of the mattress. By placing two symmetrical lateral valleys 43 and 45 at the top 39 and bottom 40 of mattress 30, user 25 cannot lay the mattress down on a bed frame in the incorrect orientation with the head of the mattress towards the foot of the bed frame. Regardless of how the mattress is laid down on the bed, the valleys of softer foam for the shoulders are present without fail within the correct area of the mattress to contact the user's shoulders. The region of middle lateral valley 44 occupies the entire length of mattress 30 from thirty inches from the top 39 to thirty inches from the bottom 40 of the mattress. Thus, for a 75-inch long twin size mattress, the region of valley 44 is about fifteen inches long. For an 80-inch long queen size mattress, the region of valley 44 is about twenty inches long.

Mattress 30 does not have a zone of the wavy foam layers that is specifically tailored to the legs of a person reclining on the mattress. Instead, a user's legs lie over the regions of the lateral valleys 43 or 45 positioned for the shoulders. The benefit of always positioning a user's shoulders correctly over the region of a lateral valley, regardless of whether the user lies toward the top 39 or bottom 40 of mattress 30, outweighs the lack of optimum leg support. Providing a foam zone with an indentation load deflection (ILD) specifically suited to support a user's legs contributes much less to keeping the reclining user's spine straight than does positioning lateral regions with the appropriate ILDs beneath the user's shoulders and hips. Moreover, foam zones intended to support the legs are often ineffective. Where a tall man and a short woman are lying on the same mattress, their shoulders will likely rest at the same distance from the end of the mattress, whereas their legs will likely not rest in the same lateral region. Thus, any foam zone with an ILD specifically suited to support a user's legs would not be in the appropriate position for both the tall man and the short woman. Instead of offering multiple ineffective indentation zones, mattress 30 provides a shoulder foam zone that is always correctly positioned and a variable width hip foam zone that is appropriate for the largest percentage of North American consumers.

Figure 6:
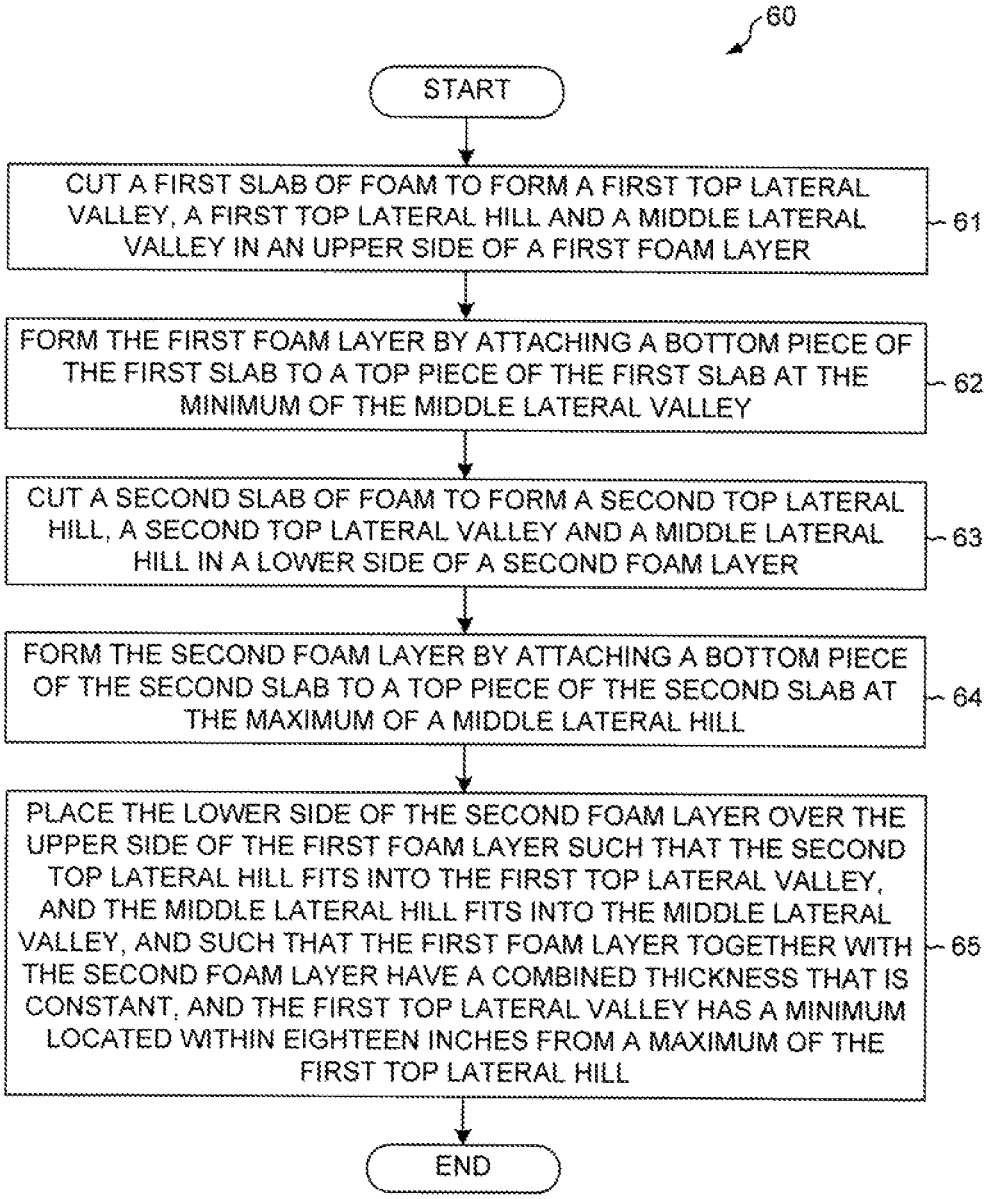
FIG. 6 is a flowchart of steps for manufacturing a symmetrical zoned foam mattress with wavy layers that does not involve gluing together lateral foam blocks of different hardness.
Figure 7:
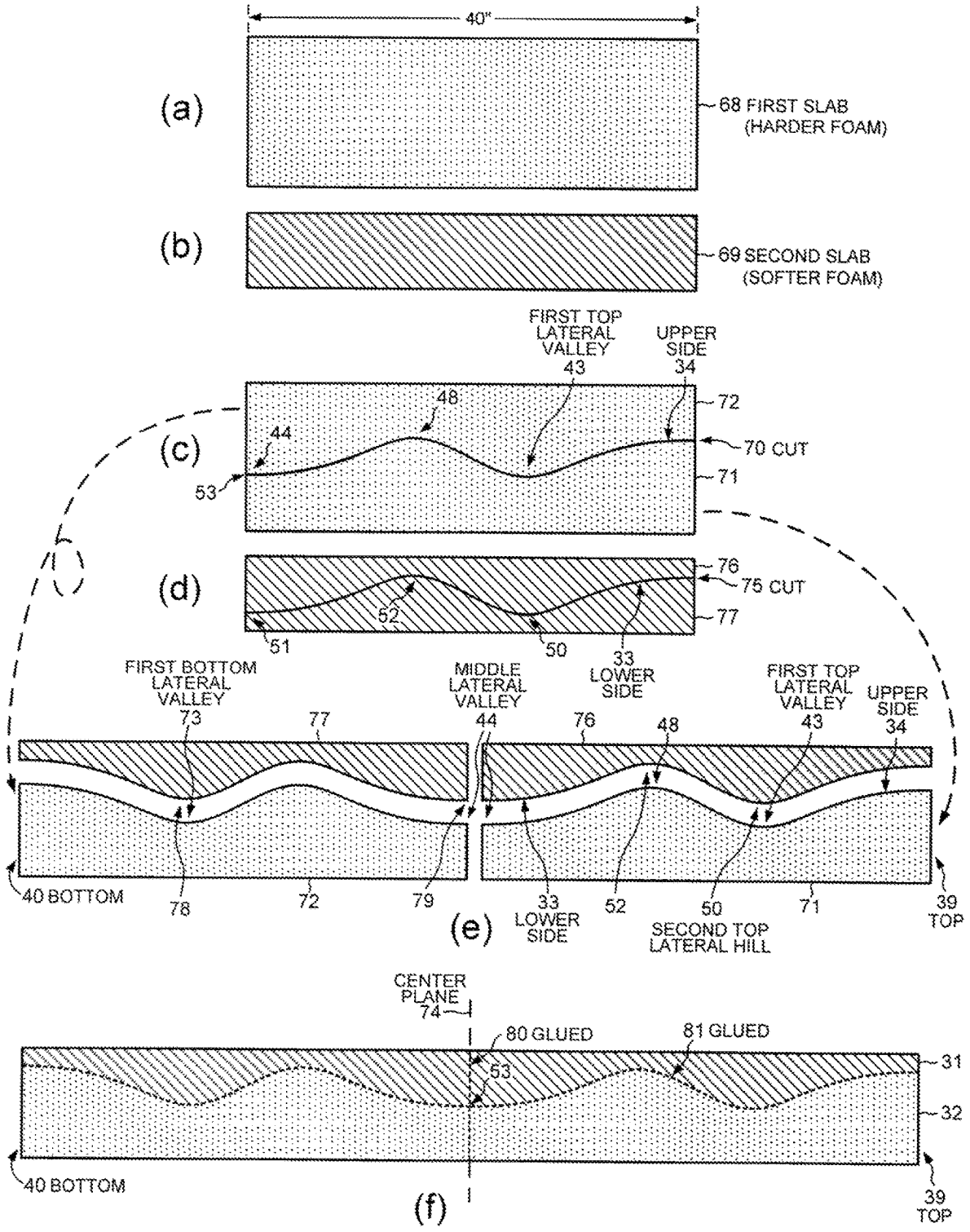
FIG. 7 illustrates how the steps of the method of FIG. 6 are performed on slabs of memory foam and HD foam to manufacture a symmetrical zoned foam mattress.

FIG. 6 is a flowchart illustrating steps 61-65 of a method 60 of manufacturing symmetrical zoned foam mattress 30. Method 60 does not involve gluing together lateral foam blocks to form zones of different hardness. Moreover, method 60 forms the wavy sides of layers 31-32 without molding foam to form the waves. The steps of method 60 are illustrated in FIG. 7. The wavy foam layers 31-32 are formed from a first slab 68 of harder foam and a second slab 69 of softer foam. For example, first slab 68 is used to make lower foam layer 32 and has a density of about three pounds per square foot and an ILD of about fifteen. Second slab 69 is used to make upper foam layer 31 and has a density of about four pounds per square foot and an ILD of about nine. Thus, the visco-elastic polyurethane foam (memory foam) of first slab 68 has a higher density than the high-density polyurethane foam (HD foam) of second slab 69. Bottom foam layer 56 has a density of about three pounds per square foot and an ILD of about twenty five. Thin top foam layer 55 has a density of about 1.5 lbs/sqft and an ILD of about five. Each of the slabs of foam 68-69 is half as long as the mattress 30. To make an 80-inch-long queen size mattress, the slabs 68-69 are each forty inches long.

In a first step 61, first slab 68 is cut to form first top lateral valley 43, first top lateral hill 48 and middle lateral valley 44 in wavy upper side 34. The cut 70 in first slab 68 forms a bottom piece 71 and a top piece 72. First top lateral valley 43 and first top lateral hill 48 are on bottom piece 71. Top piece 72 has a first bottom lateral valley 73.

In step 62, lower foam layer 32 is formed by attaching bottom piece 71 to top piece 72 at minimum 53 of middle lateral valley 44 as shown in step (e) of FIG. 7. Top piece 72 is flipped upside down before it is attached to bottom piece 71. Because the same cut 70 forms both bottom piece 71 and top piece 72, the curve of upper side 34 is symmetrical on either side of middle lateral valley 44 at which bottom and top pieces 71-72 are attached. Thus, first top lateral valley 43 and first bottom lateral valley 73 are disposed symmetrically to a center plane 74 of lower foam layer 32 that intersects the upper side 34 of lower foam layer 32 at minimum 53 of middle lateral valley 44.

In step 63, second slab 69 is cut to form second top lateral hill 50, second top lateral valley 52 and middle lateral hill 51 in wavy lower side 33 of upper foam layer 31. The cut 75 in second slab 69 forms a top piece 76 and a bottom piece 77. Cut 75 has the same shape as cut 70. Second top lateral hill 50 and second top lateral valley 52 are on top piece 76. Bottom piece 77 has a second bottom lateral hill 78.

In step 64, upper foam layer 31 is formed by attaching top piece 76 to bottom piece 77 at a maximum 79 of middle lateral hill 51 as shown in step (e) of FIG. 7. Bottom piece 77 is flipped upside down before it is attached to top piece 76. Because the same cut 75 forms both top piece 76 and bottom piece 77, the curve of lower side 33 is symmetrical on either side of middle lateral hill 51 at which top and bottom pieces 76-77 are attached. Thus, second top lateral hill 50 and second bottom lateral hill 78 are disposed symmetrically to center plane 74 of upper foam layer 31 that intersects upper side 33 of upper foam layer 31 at maximum 79 of middle lateral hill 51. Top and bottom pieces 76-77 are attached by gluing 80, as are top and bottom pieces 72-71.

In step 65, lower side 33 of upper foam layer 31 is placed over upper side 34 of lower foam layer 32 such that second top lateral hill 50 fits into first top lateral valley 43, and middle lateral hill 51 fits into middle lateral valley 44. First top lateral valley 43 has a minimum 46 located within eighteen inches from maximum 49 of first top lateral hill 48. Upper foam layer 31 is attached to lower foam layer 32 by gluing 81. After upper foam layer 31 is attached to lower foam layer 32, upper foam layer 31 together with lower foam layer 32 have a combined thickness that is constant, as shown in step (f) of FIG. 7.

Figure 8:
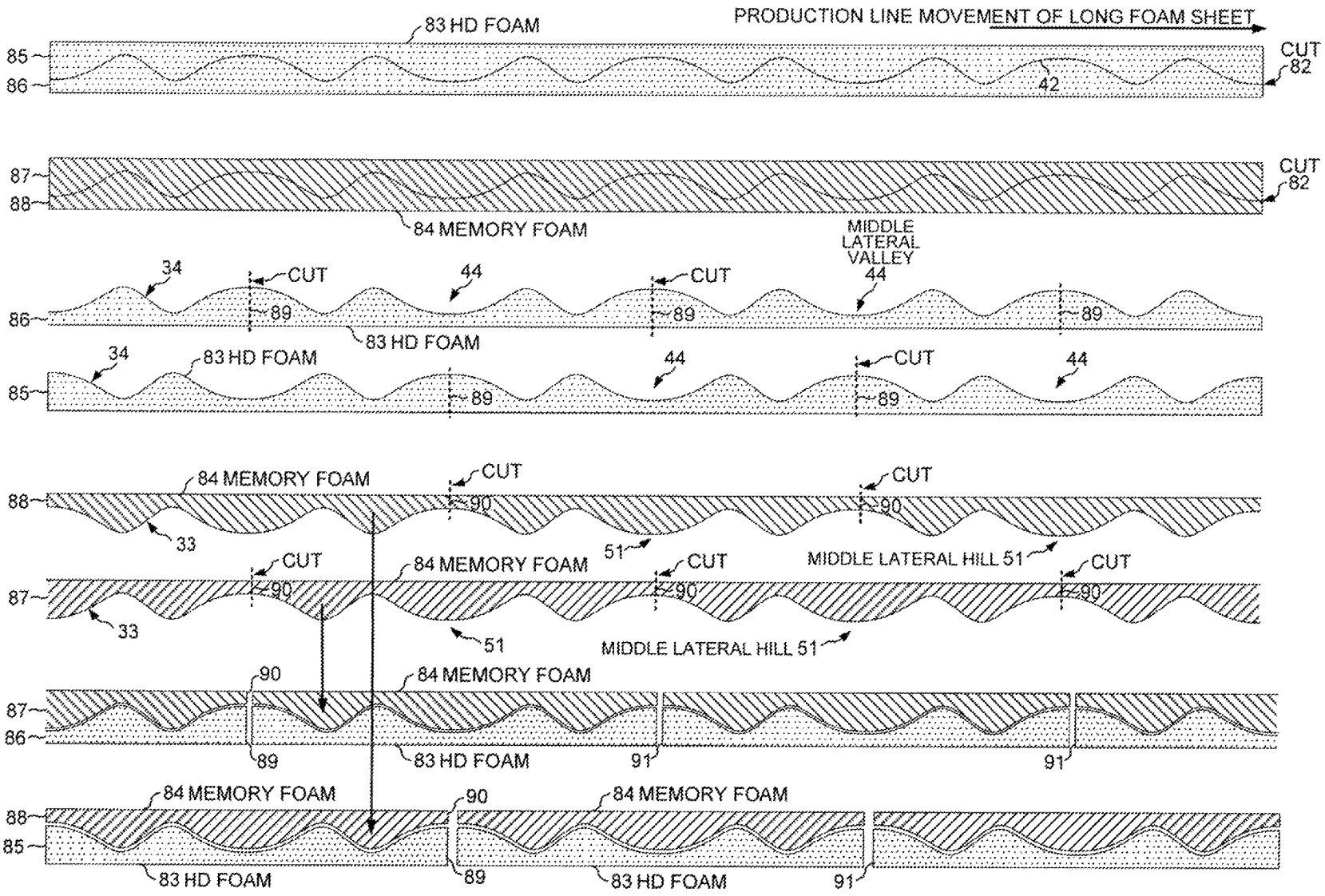
FIG. 8 illustrates an adaptation of the method of FIG. 6 that allows the symmetrical zoned foam mattress to be manufactured more efficiently using long sheets of foam.

FIG. 8 illustrates an adaptation of method 60 that allows the symmetrical zoned foam mattress 30 to be manufactured even more efficiently. Instead of beginning with short slabs of foam, as shown in FIG. 7, mattress 30 is made with long sheets of foam. In one embodiment, the long sheets are made in a continuous process. As each long foam sheet moves along a production line, a cutting device moves up and down to create a continuous cut 82 that repeats the curve 42. To make an 80-inch-long queen size mattress, the curve 42 is repeated every eighty inches.

Two long foam sheets are used: one made of HD foam 83 and the other made of memory foam 84. The HD foam 83 is used to make lower foam layer 32, and the memory foam 84 is used to make upper foam layer 31. The foam sheets need not have the same thickness as shown in FIG. 8. A thicker sheet of HD foam 84 is usually used because HD foam is less expensive than memory foam. The lower foam layer 32 of HD foam acts as a support for the softer upper foam layer 31. Despite the different thicknesses of the HD and memory foam, the same cut 82 with the same curve 42 must be applied to both sheets of foam. Cut 82 is made in the middle of the thickness of the foam sheets.

The two long foam sheets of HD foam 83 and memory foam 84 are cut into four wavy layers, designated as 85, 86, 87, 88 in FIG. 8. Wavy layer 85 of HD foam 83 is flipped over such that its flat side is down. Wavy layer 88 of memory foam 84 is flipped over such that its flat side is up. In a first embodiment of the method, upper wavy layers 87-88 are shifted 180 degrees along curve 42 (half of the curve), placed over lower wavy layers 86-85, respectively, and then cut every eighty inches.

In a second embodiment, the wavy layers 85-88 are first cut and then placed over each other. Lower wavy foam layer 85 is cut to form a first planar top side 89 that is approximately forty inches from middle lateral valley 44. Lower wavy foam layer 86 is cut in the same manner. Thus, middle lateral valley 44 is in the middle of each 80-inch segment of foam layers 85-86, as shown in FIG. 8. Upper wavy foam layer 87 is cut to form a second planar top side 90 that is approximately forty inches from middle lateral hill 51. Upper wavy foam layer 88 is cut in the same manner. Lower side 33 of upper layer 87 is then place over upper side 34 of lower layer 86 such that middle lateral hill 51 fits into middle lateral valley 44. Similarly, upper layer 88 is place over lower layer 85 such that middle lateral hill 51 fits into middle lateral valley 44. After the placing of lower side 33 of upper foam layer 87 over upper side 34 of lower foam layer 86, first planar top side 89 and second planar top side 90 are coplanar and form the top 39 of mattress 30.

Cutting lower wavy foam layer 85 to form first planar top side 89 also forms a first planar bottom side 91 of the adjacent 80-inch segment to the right in FIG. 8. First planar bottom side 91 is approximately forty inches from the middle lateral valley 44 of the adjacent segment to the right. As shown in FIG. 8, for each segment of lower foam layer 85, upper side 34 from the minimum 53 of middle lateral valley 44 towards first planar top side 89 on the right of the segment is a mirror image of upper side 34 from minimum 53 of middle lateral valley 44 towards first planar bottom side 91 on the left of the segment.

By cutting the sheets of foam along curve 42, each segment and also each mattress has lateral wavy foam zones that are symmetrical from top to bottom. This prevents the user 25 from placing the head side of the mattress at the foot of the bed, which would be possible if the curve of the wavy foam zones was not symmetrical with respect to the middle of the mattress. Cutting the sheets of foam along curve 42 also provides wavy foam zones in the correct position for the body zones of the largest segment of North American users. Regardless of body height, the average North American consumer sleeps with his or her shoulders about fifteen inches from the top of the mattress, which falls at the maximum of second top lateral hill 50 of the upper layer 31 of memory foam.

Figure 9:
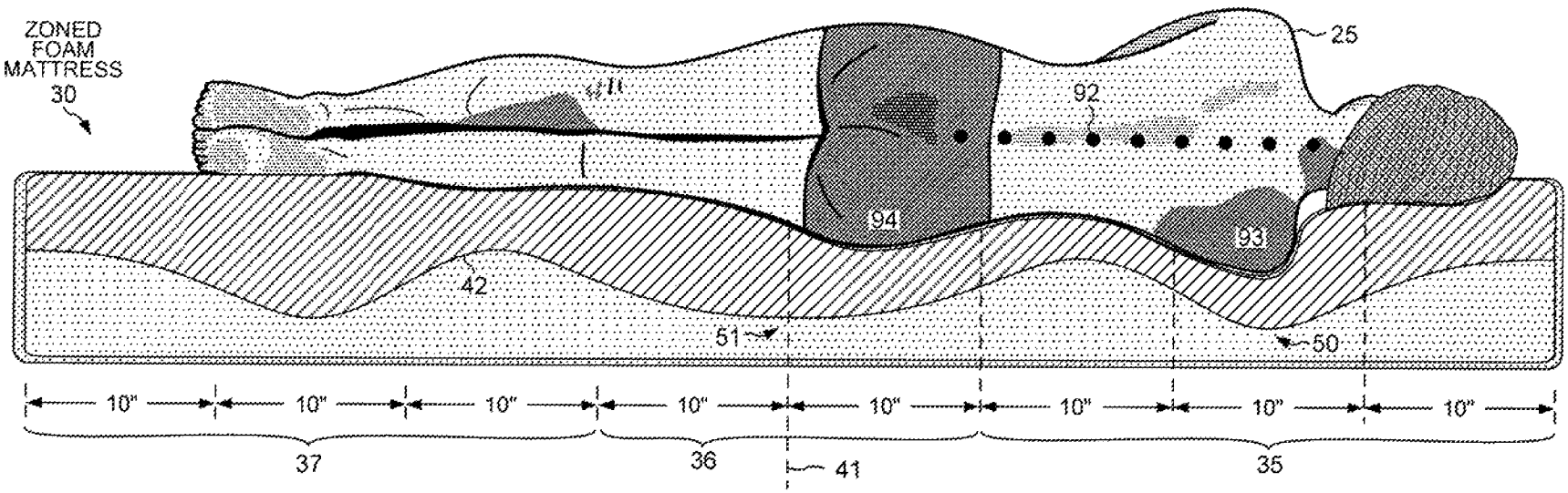
FIG. 9 is a cross-sectional view showing a user's shoulders sinking into the thicker memory foam over the second top lateral hill, and the user's hips sinking into the thicker memory foam above the middle lateral hill of the upper wavy foam layer.

FIG. 9 illustrates how mattress 30 permits the user's spine 92 to remain straight when the shoulders 93 and hips 94 can sink farther into the mattress. FIG. 9 shows that the user's shoulders 93 sink into the thicker memory foam over second top lateral hill 50, and the user's hips 94 sink into the thicker memory foam above middle lateral hill 51. In order to achieve spinal alignment, the supporting forces of the mattress, under the load of the reclining body, must vary along the body to match the body density and shape. But in order for the mattress to be comfortable, the supporting pressures of the mattress against the skin must also be even over the entire body. A straight side-lying spinal alignment of a reclining user is generally considered to be that alignment in which the spine is straight and on the same center line as the legs and the head as shown by the dots along spine 92 of user 25 in FIG. 9.

Although certain specific embodiments are described above for instructional purposes, the teachings of this patent document have general applicability and are not limited to the specific embodiments described above. Although a particular curve 42 is cut into the long sheets of foam to make mattress 30 as shown in FIG. 8, other shaped curves can also be used. Any other curve can be used that is both symmetrically relative to center plane 41 and that conforms to the locations of the shoulders and hips of a selected group of users. The top and bottom of each segment of the lower wavy foam layers 85-86 is then cut so as to be offset by 180 degrees of the curve from the top and bottom cuts in the upper wavy foam layers 87-88. Accordingly, various modifications, adaptations, and combinations of various features of the described embodiments can be practiced without departing from the scope of the invention as set forth in the claims.

What is claimed is:

1. A method of making a mattress, comprising:

cutting a first slab of foam to form a first top lateral valley, a first top lateral hill and a middle lateral valley of an upper side of a first foam layer;

cutting a second slab of foam to form a second top lateral hill, a second top lateral valley and a middle lateral hill of a lower side of a second foam layer; and placing the lower side of the second foam layer over the upper side of the first foam layer such that the second top lateral hill fits into and is adjacent to the first top lateral valley, and the middle lateral hill fits into the middle lateral valley, wherein the first top lateral valley has a minimum located between twelve and eighteen inches from a maximum of the first top lateral hill, and wherein the first foam layer together with the second foam layer have a combined thickness that is constant.

2. The method of claim 1, further comprising:

cutting the first foam layer to form a first planar top side that is approximately forty inches from the middle lateral valley.

3. The method of claim 2, further comprising:

cutting the second foam layer to form a second planar top side that is approximately forty inches from the middle lateral hill, wherein the first planar top side and the second planar top side are coplanar after the placing the lower side of the second foam layer over the upper side of the first foam layer.

4. The method of claim 2, further comprising:

cutting the first foam layer to form a first planar bottom side that is approximately forty inches from the middle lateral valley, wherein the upper side from a minimum of the middle lateral valley towards the first planar top side is a mirror image of the upper side from the minimum of the middle lateral valley towards the first planar bottom side.

5. The method of claim 1, wherein the first foam layer has a top, wherein the minimum of the first top lateral valley is located between twelve and eighteen inches from the top of the first foam layer.

6. The method of claim 1, wherein the first foam layer has a center plane, and wherein the center plane intersects the upper side of the first foam layer at a minimum of the middle lateral valley.

7. The method of claim 1, wherein the cutting the first slab forms a top piece and a bottom piece, wherein the first top lateral valley and the first top lateral hill are on the bottom piece, further comprising:

forming the first foam layer by attaching the bottom piece to the top piece at a minimum of the middle lateral valley.

8. The method of claim 7, wherein the top piece has a first bottom lateral valley, and wherein the first top lateral valley and the first bottom lateral valley are disposed symmetrically to a center plane of the first foam layer that intersects the upper side of the first foam layer at the minimum of the middle lateral valley.

9. The method of claim 1, wherein an indentation load deflection (ILD) above the top lateral valley is lower than above other lateral regions immediately adjacent to the top lateral valley after the lower side of the second foam layer is placed over the upper side of the first foam layer.

10. The method of claim 1, wherein the first foam layer is made of high-density polyurethane foam, and wherein the second foam layer is made of memory foam.

11. The method of claim 10, wherein the memory foam of the second foam layer over the top lateral valley of the first foam layer imparts an indentation load deflection (ILD) to the mattress above the top lateral valley that allows a person's shoulders to sink into the mattress so as to keep the person's spine straight.

12. A method of making a mattress, comprising:

forming a first top lateral valley, a first top lateral hill and a middle lateral valley on an upper side of a first foam layer;

forming a second top lateral hill, a second top lateral valley and a middle lateral hill on a lower side of a second foam layer;

cutting the first foam layer to form a first planar top side that is approximately forty inches from the middle lateral valley;

cutting the second foam layer to form a second planar top side that is approximately forty inches from the middle lateral hill; and placing the lower side of the second foam layer over the upper side of the first foam layer such that the second top lateral hill fits into and is adjacent to the first top lateral valley, and the middle lateral hill fits into the middle lateral valley, wherein the first planar top side and the second planar top side are coplanar after the placing the lower side of the second foam layer over the upper side of the first foam layer; wherein the first top lateral valley has a minimum located between twelve and eighteen inches from the first planar top side, and wherein the first foam layer together with the second foam layer have a combined thickness that is constant.

13. The method of claim 12, wherein the first top lateral valley, the first top lateral hill and the middle lateral valley are formed by cutting a first slab of foam.

14. The method of claim 12, wherein the second top lateral hill, the second top lateral valley and the middle lateral hill are formed by cutting a second slab of foam.

15. The method of claim 12, wherein an indentation load deflection (ILD) above the top lateral valley is lower than above other lateral regions immediately adjacent to the top lateral valley after the lower side of the second foam layer is placed over the upper side of the first foam layer.

16. The method of claim 12, wherein the first foam layer is made of high-density polyurethane foam, and wherein the second foam layer is made of memory foam.

17. The method of claim 12, wherein the first foam layer is made of high-density polyurethane foam, and wherein the second foam layer is made of memory foam.

18. The method of claim 17, wherein the memory foam of the second foam layer over the top lateral valley of the first foam layer imparts an indentation load deflection (ILD) to the mattress above the top lateral valley that allows a person's shoulders to sink into the mattress so as to keep the person's spine straight.

* * * * *